US009103497B1

(12) United States Patent
Bernert, Jr.

(10) Patent No.: US 9,103,497 B1
(45) Date of Patent: Aug. 11, 2015

(54) ELIMINATION OF FOG FORMATION DURING AMBIENT AIR REGASIFICATION OF LIQUEFIED NATURAL GAS

(76) Inventor: Robert E. Bernert, Jr., Dartmouth, MA (US)

( * ) Notice: Subject to any disclaimer, the term of this patent is extended or adjusted under 35 U.S.C. 154(b) by 376 days.

(21) Appl. No.: 13/507,728

(22) Filed: Jul. 24, 2012

Related U.S. Application Data

(60) Provisional application No. 61/574,090, filed on Jul. 27, 2011.

(51) Int. Cl.

| | |
|---|---|
| ***F17C 9/02*** | (2006.01) |
| ***F24F 3/147*** | (2006.01) |
| ***F24F 12/00*** | (2006.01) |
| ***F17C 7/04*** | (2006.01) |
| *F28D 21/00* | (2006.01) |
| *E01H 13/00* | (2006.01) |

(52) U.S. Cl.
CPC ... *F17C 9/02* (2013.01); *F17C 7/04* (2013.01); *F24F 3/147* (2013.01); *F24F 12/001* (2013.01); *E01H 13/00* (2013.01); *F17C 2223/0161* (2013.01); *F17C 2227/0311* (2013.01); *F17C 2227/0313* (2013.01); *F17C 2227/0393* (2013.01); *F17C 2260/032* (2013.01); *F28D 2021/0064* (2013.01)

(58) Field of Classification Search
CPC ..... F24F 3/147; F24F 12/001; F24F 12/006; F24F 13/04; F24F 2012/001; F24F 2012/007; F24F 2012/00; F17C 9/02; F17C 2223/0161; F17C 2227/0393; F17C 2227/0309; F17C 2227/0311; F17C 7/04; F17C 2227/0313; F17C 2260/032; E01H 13/00; F28D 2021/0064
USPC ..... 62/50.2
See application file for complete search history.

(56) References Cited

U.S. PATENT DOCUMENTS

| | | | | |
|---|---|---|---|---|
| 3,598,313 | A | 8/1971 | Plattner | |
| 3,978,663 | A * | 9/1976 | Mandrin et al. | 60/728 |
| 4,331,129 | A | 5/1982 | Hong et al. | |
| 5,341,769 | A | 8/1994 | Ueno et al. | |
| 5,390,500 | A | 2/1995 | White et al. | |
| 5,400,588 | A | 3/1995 | Yamane et al. | |
| 5,810,248 | A | 9/1998 | Vielberth | |
| 6,164,247 | A | 12/2000 | Iwasaki et al. | |
| 6,427,454 | B1 * | 8/2002 | West | 62/93 |
| 6,644,041 | B1 | 11/2003 | Eyermann | |
| 7,137,623 | B2 | 11/2006 | Mockry et al. | |
| 7,431,270 | B2 | 10/2008 | Mockry et al. | |
| 7,493,772 | B1 * | 2/2009 | Brown | 62/50.2 |
| 7,870,747 | B1 * | 1/2011 | Brown | 62/50.2 |
| 2010/0101240 | A1 * | 4/2010 | Mak | 62/50.2 |

* cited by examiner

*Primary Examiner* — Frantz Jules
*Assistant Examiner* — Keith Raymond
(74) *Attorney, Agent, or Firm* — Robert J Doherty

(57) ABSTRACT

A system and method for regasifying LNG using ambient air vaporizers without ambient air fog formation. The warm moist ambient air is cooled and dried using cold recovery from the cryogenic LNG stream by means of an intermediate heat transfer fluid circulated in a closed loop followed by the addition of a warm diluent air stream such that the final temperature of the exit stream of mixed air is at or above the ambient air dew point. Adjustable diluent air dampers permit an induced draft ambient vaporizer assembly.

12 Claims, 1 Drawing Sheet

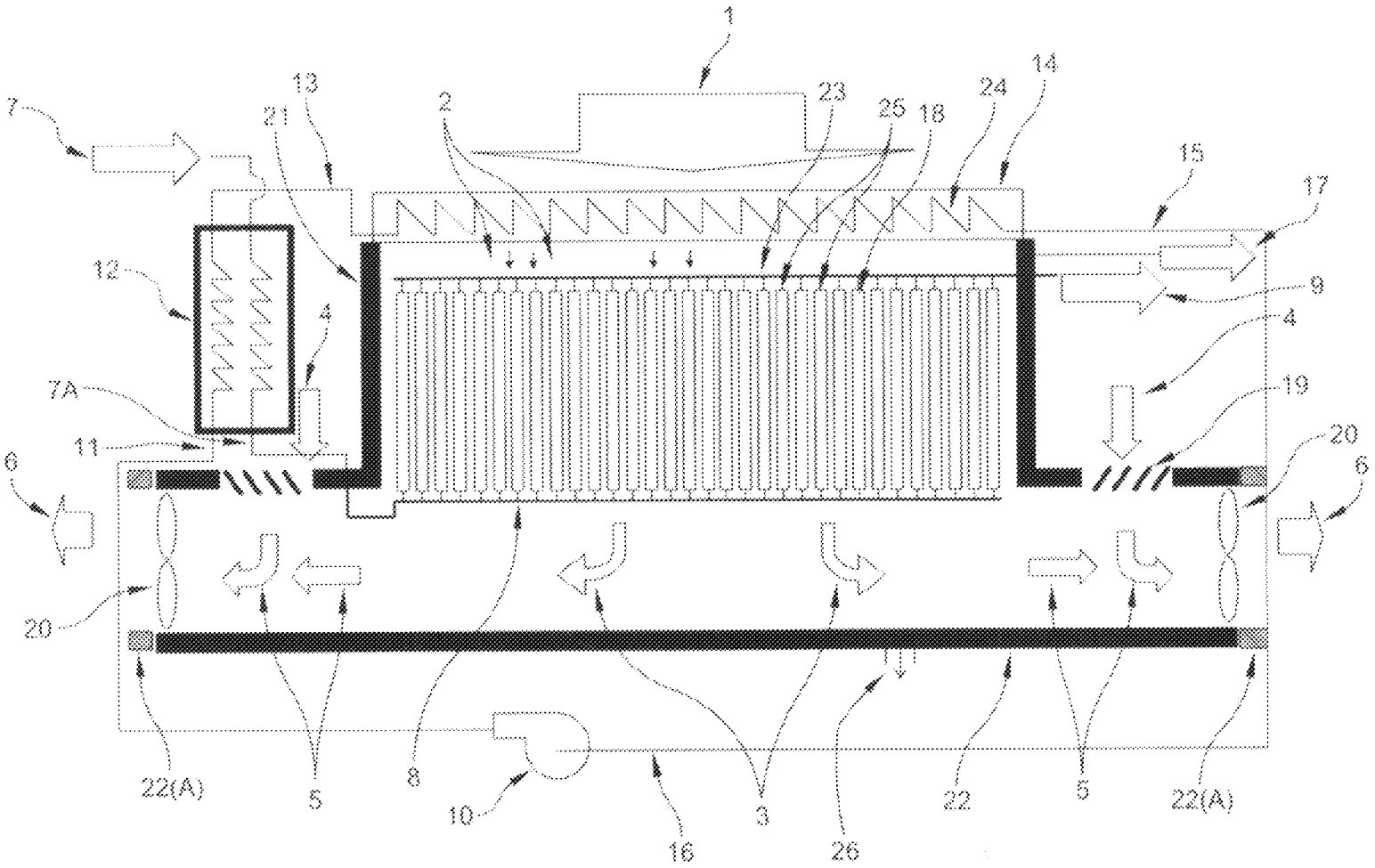
1
2
3
4
5
6
7
7A
8
9
10
11
12
13
14
15
16
17
18
19
20
21
22
22(A)
23
24
25
26

ELIMINATION OF FOG FORMATION DURING AMBIENT AIR REGASIFICATION OF LIQUEFIED NATURAL GAS

I claim the benefit of my provisional patent application Ser. No. 61/574,090 Filed Jul. 27, 2011

BACKGROUND OF THE INVENTION

1. Field of the Invention

The present invention relates to the prevention of atmospheric fog formation which is a common problem when vaporizing cryogenic fluids and Liquefied Natural Gas (LNG) using ambient air by using the cold energy of the cryogenic fluid to cool and dry the ambient air flowing to the vaporizer and using induced draft fans which reheat the cold air leaving the vaporizers with a side stream of warm ambient air. In the process, the LNG is preheated before entering the ambient air vaporizer.

2. Description of Related Art

Eyerman in U.S. Pat. No. 6,644,041 B1 shows a process for vaporizing liquefied gas (LNG) using heat from the ambient air by using an air evaporative heating tower to warm water which then transfers this heat to an intermediate fluid within a closed loop which in turn transfers its heat to the LNG which is vaporized. The heating tower is similar to the more common cooling tower art for waste heat dissipation. Such towers have the problem of recycling discharge air back into the air intake.

Iwasaki in U.S. Pat. No. 6,164,247 shows an intermediate fluid type vaporizer wherein the intermediate fluid temperature is maintained by passing sea water through the vaporizer-heat exchanger, the sea water thus supplies the heat required for the vaporization process. In many locations adequate temperature sea water is not available and environmental and corrosion issues are a concern.

Mandrin in U.S. Pat. No. 3,978,663 uses the cold energy from a vaporizing LNG stream for vaporizing the LNG which vaporized gas is fed to a turbine. The LNG is vaporized using ambient air as the heating means and subsequently the cooled air is fed to the turbine air intake, thus increasing thermodynamic efficiency. A similar process is described in Yamani U.S. Pat. No. 5,400,588

A sea water heat source is used in an LNG vaporizer described in U.S. Pat. No. 5,341,769 to Ueno. Ueno in FIG. 13 shows the relative temperature profiles of the sea water and the LNG in the counter-current flow stream in these falling (water) film type heat exchangers.

Solar energy has also been proposed as a heat source for LNG vaporizers in U.S. Pat. No. 4,331,129 by Hong. Hong discloses a solar pond which collects local solar radiation to maintain the water or other heat transfer fluid temperature to provide the required energy for vaporization.

Heating Towers using ambient air as a heat source to warm a circulating water loop in direct contact with the air are described by Mockrey in U.S. Pat. No. 7,137,623B2 and further in U.S. Pat. No. 7,431,270B2. Mockrey discusses the problem of cold dense air sinking to ground level where it can be drawn back into the cooling tower thereby reducing tower efficiency, such recycling being a common concern of ambient air heat exchangers.

Fog dissipation is widely discussed in prior art particularly concerned with naturally occurring fog banks and ground fog. For example Vielberth in U.S. Pat. No. 5,810,248 illustrates a water spray method to prevent or eliminate fog over an area of land such as an airport, roadway or large building complex. Likewise in U.S. Pat. No. 3,598,313, Plattner uses a cold air stream, which is more dense than the ground fog layer, the cold stream dispersed above the area that is to be cleared of fog, thereby clearing the fog from the area. Additionally, mixing between the top fog layer and the bottom cool-dry layer causes some of the visible fog (water) to be converted into invisible water vapor. Brown in U.S. Pat. No. 7,870,747 B1 discloses an ambient air vaporizer for liquefied gas. In the disclosure, the cold, dense, air from the vaporizer is fed via a duct into an air re-heater prior to discharge of the warmed air to the atmosphere. The purpose of the air re-heating is to obviate objectionable fog production and an (air) psychometric chart shown by Brown in FIG. 1 outlines the range of air temperatures, enthalpy range, water content of the air, etc. Such charts are in common use in the air conditioning art. Brown discloses that ambient air as the re-heat source is theoretically possible, but does not further pursue the method.

An ambient air vaporizer, fitted with a restrictive air flow apparatus to increase the effluent air temperature from the vaporizer to reduce potential fogging is disclosed in Brown U.S. Pat. No. 7,493,772 B1. Other than fog potential reduction, the disclosure is silent on the performance of the vaporizer as the flow of the natural draft stream of heating air is reduced. One skilled in the art would expect a lower vaporizer performance to be consistent with restricted an flow. In White U.S. Pat. No. 5,390,500 a typical ambient air vaporizer is disclosed. White discloses such concerns as ice formation, performance, and potential fog generation and discloses internal cryogenic flow passage elements for ice management and possible fog reduction.

SUMMARY OF THE INVENTION

The present invention is a process and apparatus for vaporizing cryogenic fluids such as Liquefied Natural Gas (LNG) comprising the steps of: (1) inducing a flow of warm ambient inlet air to a cryogenic ambient air vaporizer intake where the air is cooled and dried using cold energy from the cryogenic (LNG) fluid; (2) separating water which has condensed from the cooled ambient air stream and discharging the water as a separate discharge stream; (3) passing the thus pre-cooled and dried ambient air stream through an induced draft cryogenic ambient air vaporizer where the air is further cooled and dried as it releases heat to vaporize and super heat the cryogenic fluid; (4) collecting the effluent cooled ambient air in an exit air duct and passing it to a cold air/diluent air mixing zone of the exit air duct where it is mixed and warmed with a controlled side stream of incoming warm diluent ambient air and also draining condensed water from the exit air duct; (5) discharging the thus mixed stream of air from the vaporizer exit air duct using an induced draft fan; (6) including an intermediate heat transfer fluid, such as water, which intermediate fluid is re-circulated in closed loop fashion using a recirculation pump; (7) passing the intermediate fluid via an intermediate heat transfer fluid loop to a cryogenic heat exchanger or chiller where the intermediate fluid is cooled by the incoming cryogenic fluid; (8) passing the intermediate fluid through the ambient air intake air dryer where the fluid is warmed in heat transfer relationship with the warm incoming ambient air; (9) passing the intermediate heat transfer fluid to the re-circulation pump intake; (10) using the cold energy of the incoming cryogenic fluid by passing it through the cryogenic exchanger/intermediate fluid chiller in which the cryogenic fluid is pre-heated in a heat transfer relationship with the intermediate fluid flowing thru the chiller; (11) passing the preheated cryogenic fluid to the ambient air vaporizer where it is vaporized and superheated in a heat transfer relationship with the dried ambient air stream; and (12) passing the vaporized cryogenic fluid into a downstream pipe line for its intended use.

In the process of the present invention, the step of cooling and drying the incoming ambient air stream comprises passing the air over the exterior surface of the air dryer heat transfer elements and where the re-circulating intermediate fluid flows though the interior of the dryer heat transfer tubes or elements. Condensed water resulting from the air cooling process is separated and drained from the air stream before the air stream enters the induced draft ambient air vaporizer. The induced draft vaporizer has an air containment barrier or duct to maintain a controlled air flow stream over the exterior of the vaporizer heat transfer elements such as of the common extruded aluminum externally finned type and where the cryogenic fluid flows through the interior, tubular passage ways of the elements. The cold ambient air leaving the vaporizer is collected in a controlled fashion using an exit air duct which may be beneath the vaporizer. Water which may condense from the air flowing through the vaporizer is drained from the exit air duct. The air is then mixed with a damper controlled diluent warm air stream such that the final effluent mixed air stream has a temperature which is at or above the dew point of the surrounding ambient air, thereby preventing fog formation by the process. Further, since water has been removed from the ambient air flowing thru the intake air drier and the vaporizer, the mixed exit air will be drier than the surrounding ambient air and hence will not form fog locally as it mixes with the surrounding air. In certain large installations of such vaporizers the process can cool very large volumes of ambient air. To maintain performance it may be essential that the effluent mixed air stream does not re-enter the vaporizer process at the air intake. In this situation the effluent mixed air stream is ducted away in an air duct extension from the vaporizer air intake to prevent any interaction between incoming ambient and or diluent air and the exiting mixed air. Dew point as used herein, is defined as the air temperature at which a given mixture of air and water vapor is saturated with water vapor.

The present invention also utilizes the cold energy of the incoming cryogenic fluid advantageously in an intermediate heat transfer fluid chiller. The chiller may be a common shell and tube type heat exchanger where the cryogenic fluid, usually at a relatively high pressure, flows on the inside of the tubular fluid conduits within the chiller and the intermediate fluid which may be water or for example a glycol-water mixture having a freezing point below that of water, flows outside the tubes in the shell side of the exchanger or chiller. This particular use of the cryogen cold energy surprisingly both pre-heats the cryogen before it enters the ambient air vaporizer and removes a portion of the moisture contained in the incoming air stream to the air dryer. While the main purpose of the apparatus is to eliminate potential fog formation caused by, cryogenic ambient air vaporizers, this combination has the benefit of reducing the size of the ambient air vaporizer and further the added benefit of significantly reducing the icing problem common to ambient air vaporizers.

BRIEF DESCRIPTION OF THE DRAWING

FIG. 1 is a schematic diagram showing the system and process of the preferred embodiment of the present invention.

DETAILED DESCRIPTION OF THE INVENTION

Referring to FIG. 1 there is shown the process for the vaporization of cryogenic fluids such as Liquefied Natural Gas (LNG) in accordance with the preferred embodiment of the present invention. The process as illustrated by FIG. 1 includes a warm inlet ambient air supply stream (1), an ambient air intake air dryer (14), an intermediate heat transfer fluid loop (15) which has an intermediate fluid re-circulation pump (10), an intermediate fluid cryogenic heat exchanger-chiller (12), a cryogenic ambient air vaporizer (18), an exit air duct (22), a warm diluent ambient air inlet stream (4), a diluent air adjustable damper means (19) and an induced draft air discharge fan (20).

The incoming warm air stream (1) passes over the exterior heat transfer surface of ambient air intake air dryer (14) in heat transfer relation with chilled intermediate heat transfer fluid (or water) stream (13) which flows though the interior of ambient air dryer (14) having heat transfer tubular conduits or tubes (24) which tubes may have external fins for improved heat transfer with air inlet supply stream (1), thereby cooling the air. As the air cools below the incoming warm air dew point in the air dyer, water is condensed from the air; such water is separated from the air and discharged at (17). The cooled and dried air stream (2) leaves dryer (14) and enters cryogenic vaporizer (18) flowing downward over the exterior surface of vaporizer heat exchanger elements (25) in heat transfer relationship with the preheated cryogenic fluid stream (7A) which then enters vaporizer (18) at preheated LNG or cryogenic fluid inlet manifold (8) and passes through the interior (tubular) heat transfer conduits of vaporizer elements (25). The air stream (2) then passes thru vaporizer (18) and then exits vaporizer (18) as cold and dried air at (3), and enters exit duct (22). Since air stream (2) enters the vaporizer as saturated or 100% dew point air from air drier (14); as it gives up heat to the cryogenic fluid in vaporizer (18), the air is further cooled and dried. Condensate and/or frost from this process is drained via water drain (26). Cold leaving air (3) then passes to mixing zone (5) where it mixes with diluent warm ambient air (4) and then passes through induced draft fan (20) thereby intimately mixing the streams of the cooled air and the diluent air. The combination of cold air (3) and diluent air (4) is such that the mixture temperature and dew point is below that of the warm inlet ambient air, thru preventing fog after mixed air passing thru outlet (6) subsequently mixes with the surrounding warm ambient air. The flow of diluent air (4) is controlled via adjustable damper (19) before entering and mixing with air stream (3) at mixing zone (5). Intermediate heat transfer fluid is re-circulated through loop (15), leaving air dryer (14), enters re-circulating pump (10) at entry point (16), continuing through loop (15) to fluid chiller (12) at entry point (11). The intermediate heat transfer fluid then passes through chiller (12) in heat transfer relationship with incoming cold cryogen (7) which passes through chiller (12). The cryogenic stream (7) is preheated as it cools the intermediate fluid using the cold energy from cryogen (7). The cooled or chilled intermediate heat transfer fluid (13) then exits chiller (12) and enters air dryer (14). Cryogenic fluid (LNG) inlet stream enters chiller (12), passes though the chiller in heat transfer relationship with intermediate heat transfer fluid entering the chiller at (11). The LNG is warmed or preheated as it gives up its cold energy to the intermediate fluid (13), which intermediate fluid is cooled. The cryogenic fluid (for example LNG) exits chiller (12), as preheated cryogenic fluid (7A) passes to vaporizer inlet manifold (8), is vaporized and superheated in vaporizer (18) in heat transfer relationship with air stream (2). The cryogenic fluid (LNG) exits vaporizer (18) via exit manifold (23) as vaporized LNG (NG) (9) passing to downstream processes. Vaporizer (18) is preferably fitted with an air containment barrier (21) to control air flow through air dryer (14) and vaporizer (18) and also contain the air before it is passed into exit duct (22). Containment barrier or duct (21) provides a means to induce air to flow down through vaporizer (18) thereby improving the ambient air vaporizer performance, using fan (20), which fans also induce diluent air stream (4) to enter mixing zone (5) via adjustable control dampers (19). In a typical embodiment of the invention, in a particular climatic location where the ambient air temperature is substantially above freezing, water may be used in the intermediate fluid loop (15). For example, incoming air stream (1) enters dryer (14) at 80° F./80% RH (relative humidity), is cooled below its dew point of about 73° F., to a temperature of about 40° F./100% RH before entering vaporizer (18) where the air is further cooled to about 0° F./100% RH and condensed water from the air flowing through vaporizer (18) forms a layer of frost and or condensed water on the vaporizer heat exchange elements. The 0° F. air flows through duct (22) to mixing zone (5) where it mixes and is warmed to a temperature of about 73° F./100% RH before exiting the process at (6). Adjustable dampers (19) permit control of the mixing zone air streams to insure exit air (6) is at or above the ambient air dew point, thereby insuring that no fog is formed as exit air (6) further mixes with the surrounding warm-moist ambient air. Using the cold energy from cryogenic fluid stream (7) the intermediate fluid (water) loop is cooled to about 33° F. or above freezing before entering intake air dryer (14) and leaves the dryer at about 37° F. It will be understood by those skilled in the art that the temperatures and flow rates of the three process streams may be varied to suit a particular set of atmospheric conditions, cryogen entry and exit conditions and characteristics of the intermediate heat transfer fluid selected.

In any case, by mixing the cooled ambient air with a sufficient quantity of atmospheric diluent air to raise the temperature of exit air (6) to or above the dew point of the surrounding ambient air, assures that no fog will be produced in the ambient air surrounding the process. It is also understood that duct (22) may be extended with duct extensions (22A) to prevent exit air (6) from being recycled and/or mixed with incoming air stream (1) or with diluent inlet air (4) such mixing reducing vaporizer performance and fog prevention characteristics, The present invention preserves the advantage that ambient air vaporizers have over heated or partially heated/hybrid vaporizers by minimizing energy use for the fans and recirculating pumps and utilizing the cold energy of the cryogen to reduce heat transfer areas where at the same time eliminating atmospheric fog often created by ambient air vaporizers.

The foregoing disclosure and description is illustrative and various changes in the details or steps illustrated can be made within the scope of the appended claims without departing from the spirit of the invention.

NOTATIONS

1) Warm ambient air inlet supply stream
2) Air stream from dryer to vaporizer
3) Cold air leaving vaporizer
4) Warm ambient diluent air inlet
5) Cold air/diluent air mixing zone
6) Mixed air outlet
7) Liquefied natural gas (LNG) inlet
7A) Preheated cryogenic fluid stream from chiller
8) Preheated LNG vaporizer inlet manifold
9) Vaporized LNG (NG) to process
10) Intermediate fluid re-circulation pump
11) Intermediate flow entry to chiller
12) Cryogenic exchanger/intermediate fluid chiller
13) Chilled intermediate fluid stream
14) Ambient air intake air dryer
15) Intermediate heat transfer fluid loop
16) Intermediate fluid stream pump entry
17) Ambient air dryer condensate discharge
18) Cryogenic ambient air vaporizer
19) Diluent air adjustable damper
20) Induced draft fan
21) Air containment barrier
22) Exit air duct
22A) Air duct extension
23) Vaporized LNG outlet manifold
24) Air dryer heat transfer conduit/tubes
25) Vaporizer heat exchanger element
26) Vaporizer condensed water drain

I claim:

1. A process for vaporizing cryogenic fluids and liquefied natural gas using only ambient air heat without producing ambient air fog comprising:

a. inducing a flow of warm ambient intake air from a warm ambient air supply to a vaporizer air intake air dryer having heat transfer elements and adapted to condense and remove moisture from said flow of warm ambient intake air, b. providing said dryer with a stream of intermediate heat transfer cooling fluid, said cooling fluid flowing within said heat transfer elements of said air dryer, c. cooling said ambient intake air in said air dryer to produce cooled intake air having condensed moisture therein, d. separating said condensed moisture from said cooled intake air and discharging said moisture from the process, e. passing said cooled ambient intake air through an induced draft ambient air vaporizer having a plurality of heat transfer elements, f. further cooling and drying said ambient intake air in said ambient air vaporizer to produce a further cooled air stream, g. passing said further cooled air stream out of said vaporizer and collecting said further cooled air in an exit air discharge duct, h. conveying said further cooled air stream to a mixing zone, i. admitting a warm ambient diluent air side stream of said warm ambient air to said mixing zone and mixing said side stream with said further cooled and dried air stream such that the mixed air resulting therefrom has a temperature which is at or above the dew point of said warm ambient air supply, j. discharging said mixed air from said discharge duct through a discharge induced draft fan, and k. passing preheated cryogenic fluid to be vaporized thru said induced draft ambient air vaporizer to vaporize and super heat said cryogenic fluid whereby no ambient air fog is produced while vaporizing cryogenic fluids using only said ambient air in the vaporizer.

2. The process of claim 1 wherein said stream of cold intermediate heat transfer cooling fluid is:

a. re-circulated with an intermediate heat transfer fluid closed loop using a re-circulation pump, b. cooling said intermediate fluid in a chiller, and c. passing an inlet stream of cryogenic fluid through said chiller in heat transfer relationship with said intermediate fluid for the purpose of cooling said intermediate fluid and preheating said inlet cryogenic fluid and passing said cooled intermediate fluid from said chiller to said air dryer.

3. The process of claim 1 further comprising:

a. passing a stream of said preheated cryogenic fluid to be vaporized through the interior of said heat transfer elements of said ambient air vaporizer to vaporize and super-heat said cryogenic fluid, and b. passing said vaporized and superheated cryogenic fluid into an exit manifold for use in downstream processes.

4. The process of claim 2 wherein said intermediate heat transfer fluid is water or an anti-freeze mixture of glycol-water.

5. The process of claim 1 wherein said dryer heat transfer elements are externally finned to increase the heat transfer area of said elements exposed to said warm intake air.

6. The process of claim 1 wherein said side stream of said warm ambient air is controlled using an adjustable damper.

7. The process of claim 1 wherein said exit air discharge duct is provided with a duct extension for the purpose of separating said warm ambient air intake air streams from said mixed air discharge stream to prevent any interaction between said warm ambient intake and/or the warm ambient diluent air inlet.

8. The process of claim 6 wherein a damper control is provided with a control means and a mixed air sensor to control the mixed air discharge temperature to be about the same as the intake ambient air dew point whereby fog formation is prevented.

9. An apparatus system for vaporizing cryogenic fluids and liquefied natural gas in a cryogenic ambient air vaporizer without ambient air fog formation comprising:

a. a cryogenic ambient air vaporizer air intake air dryer having heat transfer elements in turn including b. a stream of intermediate heat transfer cooling fluid, said cooling fluid flowing within the heat transfer elements of said dryer, c. means for directing warm ambient intake air to said air dryer to cool such intake air and condense moisture from the air, d. means for separating condensed moisture from said cooled intake air and discharging said moisture from the system, e. an induced draft ambient air vaporizer and means for passing said cooled intake air through said induced draft ambient air vaporizer, f. further cooling and drying said intake air in said ambient air vaporizer, g. means for passing said further cooled air stream out of said ambient air vaporizer and collecting said further cooled air in an exit air discharge duct, h. providing a mixing zone whereby said air stream may be conveyed thereto and admitting a side stream of said warm ambient air via a side stream intake adjustable damper to said mixing zone and mixing said warm side stream with said further cooled and dried air stream such that said mixed air has a temperature which is at or above the dew point of the warm ambient air supply and discharging said mixed air from said duct via a discharge induced draft fan, and i. means for passing cryogenic fluid to be vaporized thru said induced draft ambient air vaporizer where said vaporizer using only ambient air is prevented from producing ambient air fog.

10. The apparatus of claim 9 wherein said mixed air is conveyed thru a duct extension away from said warm ambient air intake drier and said side stream intake to prevent any interaction with said warm ambient air intakes.

11. The apparatus of claim 9 wherein said intermediate heat transfer cooling fluid is recirculated in a closed loop.

12. The apparatus of claim 11 wherein said intermediate heat transfer cooling fluid is cooled in a cryogenic heat exchanger or chiller in heat transfer relationship with incoming cryogenic fluid.

* * * * *